US010825386B2

(12) United States Patent
Yan

(10) Patent No.: US 10,825,386 B2
(45) Date of Patent: Nov. 3, 2020

(54) OLED DRIVING COMPENSATION CIRCUIT AND AMOLED DISPLAY PANEL

(71) Applicant: Wuhan China Star Optoelectronics Semiconductor Display Technology Co., Ltd., Wuhan, Hubei (CN)

(72) Inventor: Weinan Yan, Guangdong (CN)

(73) Assignee: WUHAN CHINA STAR OPTOELECTRONICS SEMICONDUCTOR DISPLAY TECHNOLOGY CO., LTD., Wuhan (CN)

( * ) Notice: Subject to any disclaimer, the term of this patent is extended or adjusted under 35 U.S.C. 154(b) by 0 days.

(21) Appl. No.: 15/746,707

(22) PCT Filed: Dec. 18, 2017

(86) PCT No.: PCT/CN2017/116923
§ 371 (c)(1),
(2) Date: Oct. 26, 2018

(87) PCT Pub. No.: WO2019/095491
PCT Pub. Date: May 23, 2019

(65) Prior Publication Data

US 2019/0385519 A1 Dec. 19, 2019

(30) Foreign Application Priority Data

Nov. 14, 2017 (CN) ..... 2017 1 1120213

(51) Int. Cl.
*G09G 3/3233* (2016.01)

(52) U.S. Cl.
CPC ..... *G09G 3/3233* (2013.01)

(58) Field of Classification Search
CPC ..... G09G 3/3233; G09G 2320/0233; G09G 2300/0426; G09G 2300/043; G06F 3/0416
See application file for complete search history.

(56) References Cited

U.S. PATENT DOCUMENTS 9,589,526 B2 3/2017 Shin
9,589,856 B2 3/2017 Chou et al.
(Continued)

FOREIGN PATENT DOCUMENTS

CN 103077680 A 5/2013

OTHER PUBLICATIONS

Office Action dated Feb. 26, 2019 from corresponding application No. CN 201711120213.8.

*Primary Examiner* — Robert J Michaud
(74) *Attorney, Agent, or Firm* — Hemisphere Law, PLLC; Zhigang Ma

(57) ABSTRACT

An OLED driving compensation circuit is provided. The OLED driving compensation circuit includes an OLED, a capacitor, a driving TFT (thin film transistor), a switch TFT, a lighting TFT, and an initial TFT. The OLED driving compensation circuit further includes a compensation circuit. The compensation circuit receives a feedback current passed through the second end of the driving TFT and generates a compensation voltage according to the feedback current, and the compensation circuit is compensated by the switch TFT outputs the compensation voltage to the capacitor. An AMOLED display panel is further disclosed. However, this disclosure has advantage of improving display stability for the AMOLED display panel.

18 Claims, 5 Drawing Sheets

(56) References Cited

U.S. PATENT DOCUMENTS

| | | | | |
|---|---|---|---|---|
| 2010/0141644 | A1 | 6/2010 | Lee | |
| 2014/0071108 | A1 | 3/2014 | Han | |
| 2014/0192038 | A1* | 7/2014 | Qin | G09G 3/3258 345/212 |
| 2016/0141644 | A1 | 5/2016 | Nagano et al. | |
| 2016/0155386 | A1* | 6/2016 | Shang | G09G 3/3258 345/690 |

* cited by examiner

OLED DRIVING COMPENSATION CIRCUIT AND AMOLED DISPLAY PANEL

RELATED APPLICATIONS

The present application is a National Phase of International Application Number PCT/CN2017/116923, filed on Dec. 18, 2017, and claims the priority of China Application No. 201711120213.8, filed on Nov. 14, 2017.

FIELD OF THE DISCLOSURE

The disclosure relates to a display driving technical field, and more particularly to an OLED driving compensation circuit and an AMOLED display panel.

BACKGROUND

Since organic light emitting diode (OLED) display panel has advantages of thin, power consumption, wide viewing angle, wide color gamut, contrast characteristics, it is popular to people. The OLED display panel could be classified into passive organic light-emitting diode (PMOLED) display panel and active organic light-emitting diode (AMOLED) display panel.

However, the AMOLED display panel still has obvious flaws. For example, due to uneven condition of the panel process, threshold voltages of driving thin film transistor (TFT) are different. Although the problem of the different threshold voltages is solved by some compensation manners of current technology, the cost is that the pixel aperture ratio is reduced due to the complex compensation circuit. In addition, since the impedance of the panel is made by own-alignment, the brightness of display panel is decreased and the loading current is increased. Those problems still exist in the products that circulate in the market. Thus, stability of the AMOLED display panel is one of the important topics in the industry, and it still has a long way to go for improving this technical field.

SUMMARY

A technical problem to be solved by the disclosure is to provide an OLED driving compensation circuit and an AMOLED display panel for improving display stability in respective with the AMOLED display panel.

For solving above problem, in one aspect of this disclosure provides an OLED driving compensation circuit including an OLED, a capacitor, a driving TFT (thin film transistor), a switch TFT, a lighting TFT, and an initial TFT. A first electrode of the capacitor receives a voltage of power supply, a second electrode of the capacitor is coupled to a gate of the driving TFT, a first end of the initial TFT receives a reference voltage, and a second end of the initial TFT is coupled to a first end of the switch TFT, a gate of the initial TFT receives a first switch signal, a second end of the switch TFT is coupled to a gate of the driving TFT, a gate of the switch TFT receives a scanning signal, a first end of the driving TFT receives the voltage of power supply, a second end the driving TFT is coupled to a first end of the lighting TFT, a gate of the lighting TFT receives an enable signal, a second end of the lighting TFT is coupled to an anode of the OLED, a cathode of the OLED receives a low level voltage. The OLED driving compensation circuit further comprises a compensation circuit, the compensation circuit receives a feedback current passed through the second end of the driving TFT and generates a compensation voltage according to the feedback current, and the compensation circuit is compensated by the switch TFT outputs the compensation voltage to the capacitor.

Wherein a period of the OLED driving compensation circuit comprises a reset interval, a compensation interval and a lighting interval, in the reset interval, the initial TFT and the switch TFT are conducted, and the reference voltage is outputted to the second electrode of the capacitor via the initial TFT and the switch TFT; in the compensation interval, the initial TFT is cut off and the switch TFT is still conducted, the compensation circuit receives the feedback current to generate the compensation voltage, and the compensation voltage is outputted to the second electrode of the capacitor via the switch TFT; and in the lighting interval, the switch TFT is cut off and the lighting TFT is conducted to light the OLED.

Wherein the compensation circuit comprises a voltage converting unit, a comparison control unit, and a compensating generation unit, the voltage converting unit receives the feedback current and accordingly converts the feedback current into a feedback voltage, the comparison control unit outputs a control signal according to a comparison result of the feedback voltage and an ideal grayscale voltage respectively received by the comparison control unit, the compensating generation unit outputs the compensation voltage generated from the control signal received by the compensating generation unit to the second electrode of the capacitor via the switch TFT.

Wherein the compensating generation unit comprises a first compensation TFT, a second compensation TFT and a third compensation TFT, the control signal comprises a second switch signal and a third switch signal, a gate of the first compensation TFT receives the second switch signal, a first end of the first compensation TFT receives a high level compensation voltage and a second end of the first compensation TFT is coupled to a first end of the third compensation TFT, a first end of the second compensation TFT is coupled to the first end of the third compensation TFT, a gate of the second compensation TFT receives the second switch signal, a second end of the second compensation TFT receives a low compensation voltage, a second end of the third compensation TFT is coupled to the first end of the switch compensation TFT, a gate of the third compensation TFT receives the third switch signal, Wherein at the same time, one of the first compensation TFT and the third compensation TFT is conducted, the third switch signal controls outputting the compensation voltage to the capacitor by conducting or cutting off the third compensation TFT.

Wherein the reference voltage is the low level voltage, the compensating generation unit comprises a fourth compensation TFT, the a first end of the fourth compensation TFT receives a high level compensation voltage, a second end of the fourth compensation TFT is coupled to the first end of the switch TFT, and a gate of the fourth compensation TFT receives the control signal.

Wherein the compensation circuit further comprises a signal source and the signal source is configured to output the ideal grayscale voltage.

Wherein the signal source is configured to output a n-level ideal grayscale voltage, n is an integer greater than or equal to 2, the signal source comprises n−1 resistors, the n−1 resistors are configured to output a (n−1)-level ideal grayscale voltage, the resistance ratio of the n−1 resistors is:

$$\left(\frac{1}{n-1}\right)^{\gamma}:\left[\left(\frac{2}{n-1}\right)^{\gamma}-\right.$$

-continued $$\left(\frac{1}{n-1}\right)^{\gamma}\Big]:\ldots:\Big[\left(\frac{n-2}{n-1}\right)^{\gamma}-\left(\frac{n-3}{n-1}\right)^{\gamma}\Big]:\Big[\left(\frac{n-1}{n-1}\right)^{\gamma}-\left(\frac{n-2}{n-1}\right)^{\gamma}\Big]$$

wherein, $\gamma$ is a predetermined gamma value.

Wherein n is $2^M$, M is a positive integer.

Since the OLED driving compensation circuit further includes a compensation circuit. The compensation circuit receives a feedback current passed through the second end of the driving TFT and generates a compensation voltage according to the feedback current, and the compensation circuit is compensated by the switch TFT outputs the compensation voltage to the capacitor. Thus, the compensation voltage is able to compensate the voltage for the second electrode of the capacitor, and that is to compensate the voltage for the gate of the driving TFT, so as to achieve desired value of driving current that passes through the OLED. By achieving desired brightness and grayscale, the impact of threshold voltage, panel trace impedance for the driving current can be overcome, thus the display stability in respective with the AMOLED display panel is better.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

In order to understand the above objectives, features and advantages of the present disclosure more clearly, the present disclosure is described in detail below with references to the accompanying drawings and specific embodiments.

It will be understood that, in the description herein and throughout the claims that follow, the terms "comprise" or "comprising," "include" or "including," "have" or "having," "contain" or "containing" and the like used herein are to be understood to be open-ended, i.e., to mean including but not limited to. For example, a process, method, system, product, or device that incorporates a series of steps or units is not limited to the steps or units listed but may optionally further include steps or units not listed or may optionally further include other steps or units inherent to these processes, methods, products or devices. In addition, in the description herein and throughout the claims that follow, although the terms "first," "second," "third," etc. may be used to describe various elements, these elements should not be limited by these terms.

Figure 1:
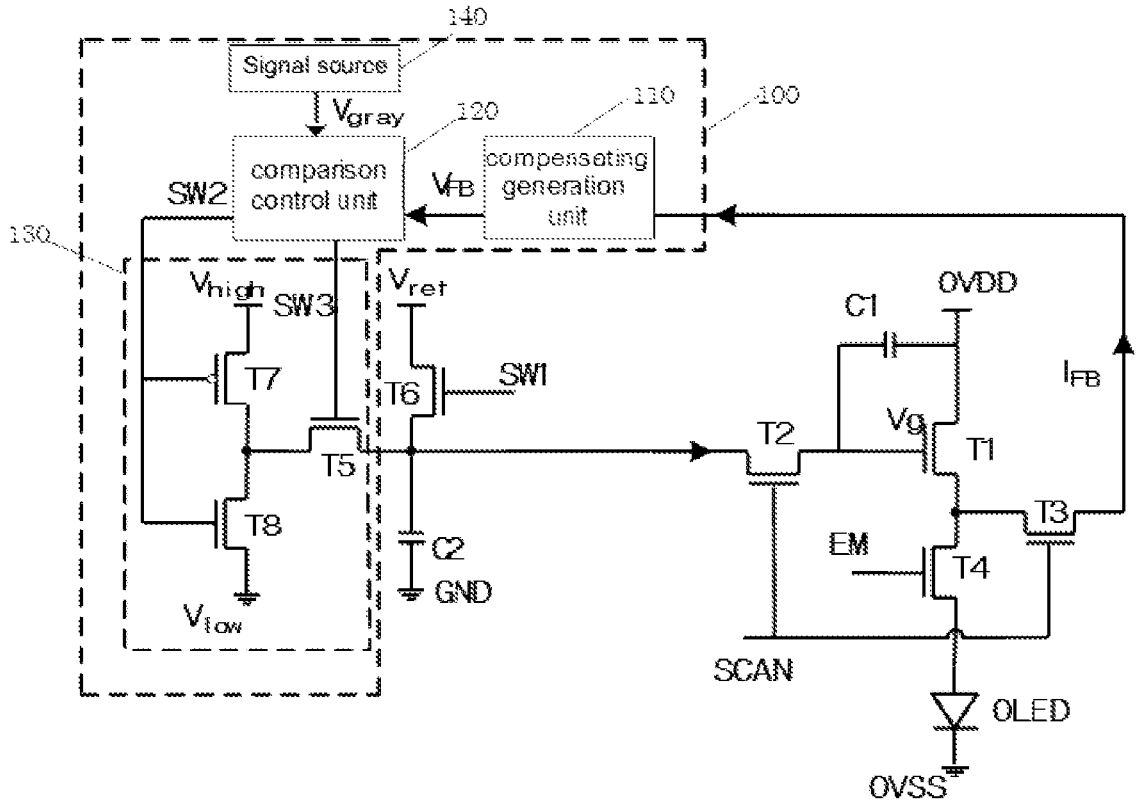
FIG. 1 is a schematic of an OLED driving compensation circuit according to first embodiment of the disclosure.

This embodiment provides an OLED driving compensation circuit. Reference is made to FIG. 1. The OLED driving compensation circuit includes an OLED, a capacitor C1, a driving TFT T1, a switch TFT T2, a lighting TFT T4, and an initial TFT T6.

In this embodiment, the OLED is configured to light and provides brightness for user observation. In this embodiment, a first electrode of the capacitor C1 receives a voltage of power supply OVDD, a second electrode of the capacitor C1 is coupled to a gate of the driving TFT T1; a first end of the initial TFT T6 receives a reference voltage $V_{ref}$, the reference voltage $V_{ref}$ is configured to initialize the capacitor C1, to discharge or charge the capacitor C1 and make the voltage of second electrode thereof to be the reference voltage $V_{ref}$. A second end of the initial TFT T6 is coupled to a first end of the switch TFT T2, a gate of the initial TFT receives a first switch signal SW1; a second end of the switch TFT T2 is coupled to a gate of the driving TFT T1 and the second electrode of the capacitor C1, and a gate of the switch TFT T2 receives a scanning signal Scan; a first end of the driving TFT T1 receives the voltage of power supply OVDD, a second end the driving TFT T1 is coupled to a first end of the lighting TFT T4, a gate of the lighting TFT T4 receives an enable signal EM, a second end of the lighting TFT T4 is coupled to an anode of the OLED, a cathode of the OLED receives a low level voltage OVSS, wherein the low level voltage OVSS is low level voltage source or ground. In this embodiment, first ends are sources and second ends are drains in respect with the OLED, the capacitor C1, the driving TFT T1, the switch TFT T2, the lighting TFT T4, and the initial TFT T6. In other embodiment, the first ends are drains and the second ends are sources in respect with the OLED, the capacitor C1, the driving TFT T1, the switch TFT T2, the lighting TFT T4, and the initial TFT T6. In this embodiment, the OLED, the capacitor C1, the driving TFT T1, the switch TFT T2, the lighting TFT T4, and the initial TFT T6 are N-type TFTs. In other embodiment, the OLED, the capacitor C1, the driving TFT T1, the switch TFT T2, the lighting TFT T4, and the initial TFT T6 are P-type TFTs. However, clock signal will be correspondingly changed hereinafter. In other embodiments of this disclosure, the OLED, the capacitor C1, the driving TFT T1, the switch TFT T2, the lighting TFT T4, and the initial TFT T6 can be different type TFTs.

For cancelling the impact of each factor for the driving current in prior arts, such as threshold voltage drifting of the driving TFT T1, and the impedance of the panel made by own-alignment. In this embodiment, the OLED driving compensation circuit further includes compensation circuit 100. The compensation circuit 100 receives a feedback current $I_{FB}$ passed through the second end of the driving TFT T1. In this embodiment, the feedback current $I_{FB}$ is in a linear relationship with the driving current of the OLED mentioned below. Preferably, by adjusting the compensation circuit 100, the feedback current $I_{FB}$ is identical to the driving current of the OLED mentioned below. In this embodiment, the compensation circuit 100 generates a compensation voltage according to the feedback current $I_{FB}$. The compensation circuit 100 is compensated by the switch TFT T2 outputs the compensation voltage to the capacitor C1. For example, if the feedback current $I_{FB}$ is smaller than desired current, the compensation circuit 100 outputs a high level of the compensation voltage to the capacitor C1, so as to raise the voltage of the capacitor C1 and raise the feedback current $I_{FB}$ gradually until desired current is achieved. At this moment, the high level of the compensation voltage is stopped to output to the capacitor C1, and the second electrode of the capacitor C1 reaches the desired voltage to drive the gate of the driving TFT T1 to reach the desired current. Thus, brightness of the OLED is reached, that is, desired grayscale is reached. In contrast, the compensation circuit 100 outputs a low level of the compensation voltage to the capacitor C1, so as to discharge the capacitor C1. In this embodiment, whether it is charging or discharging the capacitor C1, the purpose is to make the driving current of the OLED to achieve the desired current. As far as possible to improve the external factors on the OLED driving current, and to stabilize lighting of the OLED.

Figure 2:
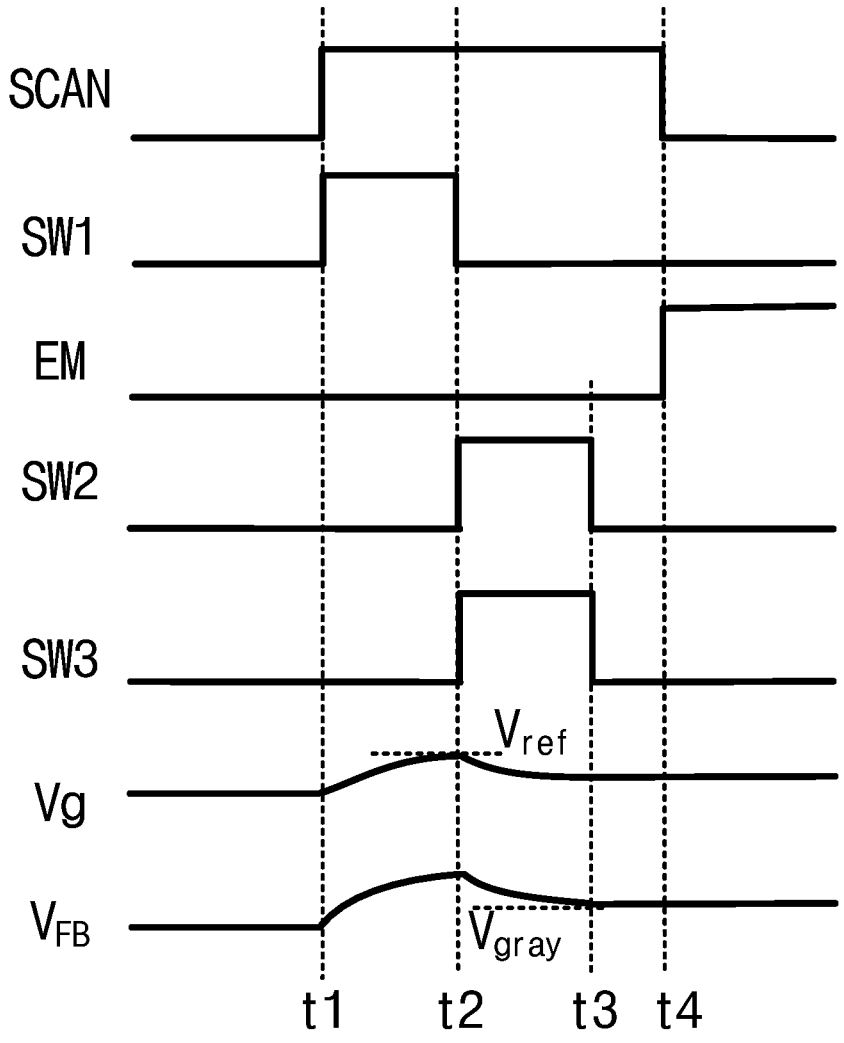
FIG. 2 is a clock schematic of the OLED driving compensation circuit according to the first embodiment of the disclosure.

Reference is made to FIG. 2, which is a clock schematic of the OLED driving compensation circuit according to the first embodiment of the disclosure. The operation of the OLED driving circuit is described as following in conjunction with FIGS. 1 and 2. In this embodiment, clock of the OLED driving compensation circuit is periodic. A period of the OLED driving compensation circuit includes a reset interval, a compensation interval and a lighting interval.

In the reset interval (shown as FIG. 2, interval between t1 and t2), the scanning signal Scan and the first switch signal SW1 are the high level voltage. The initial TFT T6 and the switch TFT T2 are conducted. Thus, the reference voltage $V_{ref}$ is outputted to the second electrode of the capacitor C1 via the initial TFT T6 and the switch TFT T2.

Figure 3:
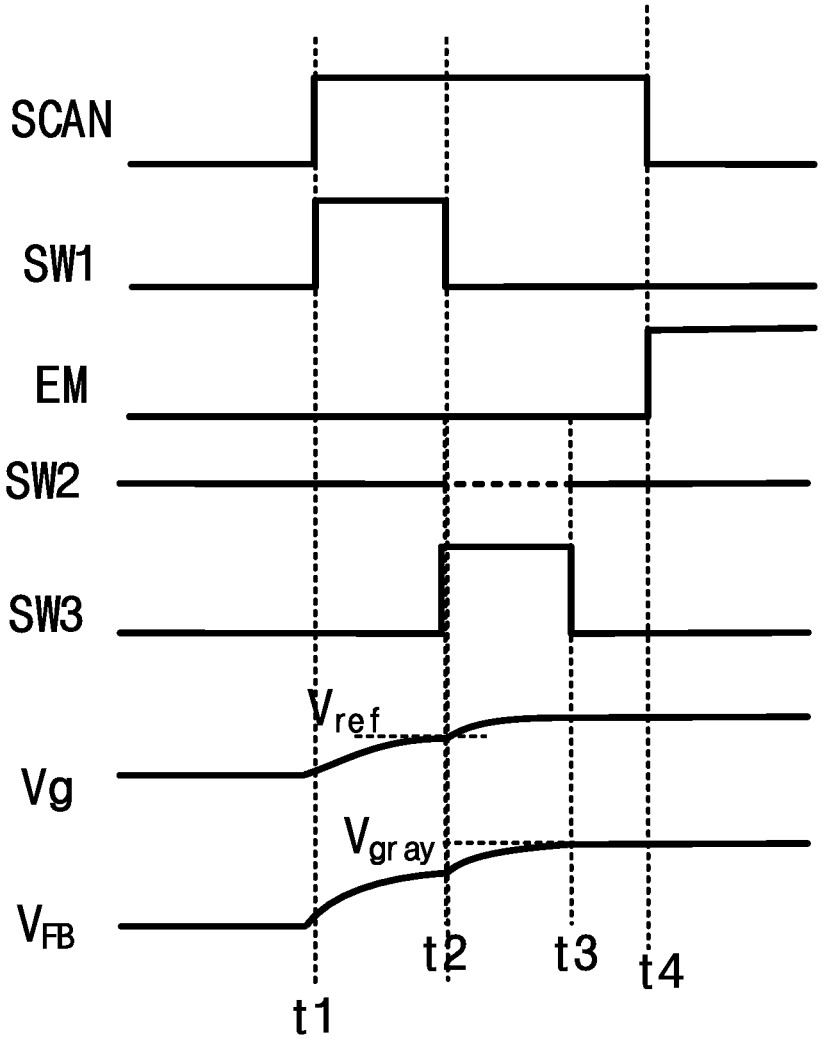
FIG. 3 is a schematic of an OLED driving compensation circuit according to another embodiment of the disclosure.

In the compensation interval (shown as FIG. 2, interval between t2 and t4), the scanning signal Scan maintains the high level of voltage. The initial TFT T6 is cut off and the switch TFT T2 is still conducted. At this moment, the driving TFT T1 and the compensation circuit 100 are formed a loop. The compensation circuit 100 receives the feedback current $I_{FB}$, wherein the feedback current $I_{FB}$ is equal to or greater than 0 A. The compensation circuit 100 generates a compensation voltage according to the feedback current $I_{FB}$, the compensation voltage is outputted to the second electrode of the capacitor C1 and the gate of the driving TFT T1 via the switch TFT T2, so as to correspondingly increase or decrease the feedback current $I_{FB}$. In this embodiment, reference is made to FIG. 2, after compensation, the voltage of the first electrode the capacitor C1 is decreased, and the voltage Vg at the gate of the driving TFT T1 is along with reduction. Thus, the voltage difference between the first end and the gate in respect with the driving TFT T1 is also decreased, and the feedback current $I_{FB}$ and the driving current during the lighting interval are also decreased. The brightness of the OLED during the lighting interval can be decreased to achieve desired brightness. In addition, in other embodiments, reference is made to FIG. 3, after compensation, the voltage of the first electrode the capacitor C1 is increased, and the voltage Vg at the gate of the driving TFT T1 is along with addition. Thus, the voltage difference between the first end and the gate in respect with the driving TFT T1 is also increased, and the feedback current $I_{FB}$ and the driving current during the lighting interval are also increased. The brightness of the OLED during the lighting interval can be increased to achieve desired brightness.

In the lighting interval (shown as FIG. 2, interval after t4), an enable signal EM is high level voltage, the lighting TFT T4 is conducted. The driving TFT T1, the lighting TFT T4, the OLED are formed a loop. The driving current of the OLED drives the OLED lighting. In this embodiment, by compensation of the compensation circuit 100, the driving current of the OLED can reach the desired value to achieve the desired brightness and grayscale on the OLED. Thus, the impact of threshold voltage, panel trace impedance for the driving current can be overcome. At this moment, the voltage at the second electrode of the capacitor C1 is corresponded to the desired driving current. Furthermore, in this interval, the loop of outputting the feedback current $I_{FB}$ to the compensation circuit 100 is cut off, so as to prevent that driving current is dispersed and influence the brightness of the OLED. Specifically, reference is made to FIG. 1. The OLED compensation circuit further includes a feedback TFT T3. A first end of the feedback TFT T3 is coupled to the second end of the driving TFT T1, a second end of the feedback TFT T3 is coupled to the compensation circuit 100, and the feedback TFT T3 receives the scanning signal Scan. Based on the clock shown in the FIG. 2, the feedback TFT T3 is conducted in the reset interval and the compensation interval, and is cut off in the lighting interval.

For achieving compensating the second electrode of the capacitor C1 by the compensation circuit 100 generates a compensation voltage in accordance with the feedback current $I_{FB}$. Please again referring to FIG. 1, the compensation circuit 100 include a voltage converting unit 110, a comparison control unit 120, and a compensating generation unit 130, the voltage converting unit 110 receives the feedback current $I_{FB}$. Specifically, the voltage converting unit 110 is coupled to the second end of the feedback TFT T3. The converting unit 110 converts the feedback current into a feedback voltage $V_{FB}$ according to the feedback current $I_{FB}$. In here, the feedback voltage $V_{FB}$ is proportional to the feedback current $I_{FB}$, and in this embodiment, the feedback voltage $V_{FB}$ is a current grayscale voltage $U_{gray}$ corresponded to the OLED driving current under this condition in the lighting interval. That is, the second electrode of the capacitor C1 is not compensated under this condition in the lighting interval. Thus, the driving current passes the OLED to light the OLED, the current grayscale voltage $U_{gray}$ corresponded to the brightness of the OLED is identical to the feedback voltage $V_{FB}$. In this embodiment, the relationship among the current grayscale voltage $U_{gray}$, the feedback current $I_{FB}$, the feedback voltage $V_{FB}$, which are corresponded to the brightness of the OLED while do not compensate voltage for the second electrode of the capacitor C1, is as following:

$$U_{gray}=\sigma\cdot I_{FB}=V_{FB},$$

wherein σ is a conversion coefficient, which is adjustable.

In this embodiment, the feedback voltage $V_{FB}$ and an ideal grayscale voltage $V_{gray}$ respectively received by the comparison control unit 120, in here, the ideal grayscale voltage $V_{gray}$ is the voltage corresponded to the desired grayscale for display. That is the data voltage from very beginning, and the ideal grayscale voltage $V_{gray}$ is corresponded to the desired grayscale and brightness for display. Thus, to compare the ideal grayscale voltage $V_{gray}$ and the feedback voltage $V_{FB}$, and determines whether the desired grayscale of the OLED is reached or not in current according to the comparison result, that is, whether the brightness requirement is satisfied or not. If the feedback voltage $V_{FB}$ is smaller than the ideal grayscale voltage $V_{gray}$, the driving current passed through the OLED is smaller, and brightness of the OLED doesn't reach desired brightness. That is means the value is smaller than the desired grayscale. Thus, the voltage Vg at the gate of the driving TFT T1 should be raised, and the voltage at the second electrode of the capacitor C1 also should be raised. The voltage at the second electrode of the capacitor C1 is raised by charging the capacitor C1 with the compensation voltage. In contrast, if the feedback voltage $V_{FB}$ is greater than the ideal grayscale voltage $V_{gray}$, the driving current passed through the OLED is greater, and the brightness of the OLED exceeds desired brightness. That is means the value is greater than the desired grayscale. Thus, the voltage $V_g$ at the gate of the driving TFT T1 should be decreased, and the voltage at the second electrode of the capacitor C1 also should be decreased. The voltage at the second electrode of the capacitor C1 is decreased by discharging the capacitor C1 with the compensation voltage. In this embodiment, the comparison control unit 120 outputs a control signal to the compensating generation unit 130 according to a comparison result. In this embodiment, the compensating generation unit 130 includes a second compensation TFT SW2, and a third compensation TFT SW3. The compensation voltage includes high level high level compensation voltage $V_{high}$ and low level compensation voltage $V_{low}$.

In this embodiment, the compensating generation unit 130 receives the control signal and generates the compensation voltage. The compensation voltage is outputted to the second electrode of the capacitor C1 via the switch TFT T2 to discharging or charging the second electrode of the capacitor C1. Specifically, the compensating generation unit 130 comprises a first compensation TFT T7, a second compensation TFT T8 and a third compensation TFT T5. The gate of the first compensation TFT T7 receives the second switch signal SW2, a first end of the first compensation TFT T7 receives a high level compensation voltage $V_{high}$ and a second end of the first compensation TFT T7 is coupled to a first end of the third compensation TFT T5, a gate of the second compensation TFT T8 receives the second switch signal SW2, a first end of the second compensation TFT T8 is coupled to the first end of the third compensation TFT T5, and a second end of the second compensation TFT T8 receives a low level compensation voltage $V_{low}$. A second end of the third compensation TFT T5 is coupled to the first end of the switch compensation TFT T2, and a gate of the third compensation TFT T5 receives the third switch signal SW3. In this embodiment, at the same time, one of the first compensation TFT T7 and the second compensation TFT T8 is conducted. In this embodiment, the first compensation TFT T7 is P-type TFT and the second compensation TFT T8 is N-type TFT. In other embodiments, the first compensation TFT T7 can be N-type TFT and the second compensation TFT T8 can be P-type TFT. In this embodiment, the third compensation TFT T5 is N-type TFT. In other embodiments, the third compensation TFT T5 can be P-type TFT.

The operation of the compensation circuit 100 is described as following in conjunction with FIGS. 1 and 2. In the compensation interval, generally, the third switch signal is high level voltage. Thus, the third compensation TFT T5 is conducted, and the second switch signal SW2 controls high or low level voltage signals according to the result of the comparison control unit 120. Specifically, if the result of the comparison control unit 120 is that the feedback voltage $V_{FB}$ is smaller than the ideal grayscale voltage $V_{gray}$, the second switch signal SW2 is the low level voltage, so as to conduct the first compensation TFT T7 and cut off the second compensation TFT T8. The high level compensation voltage $V_{high}$ is outputted to the second electrode of the capacitor C1 via the first compensation TFT T7, the third compensation TFT T5, and the switch TFT T2, and the capacitor C1 is charged and the feedback current $I_{FB}$ is gradually raised. If the result of the comparison control unit 120 is that the feedback voltage $V_{FB}$ is greater than the ideal grayscale voltage $V_{gray}$, the second switch signal SW2 is the high level voltage, so as to cut off the first compensation TFT T7 and conduct the second compensation TFT T8. The low level compensation voltage $V_{low}$ is outputted to the second electrode of the capacitor C1 via the second compensation TFT T8, the third compensation TFT T5, and the switch TFT T2, and the capacitor C1 is discharged and the feedback current $I_{FB}$ is gradually decreased. In response to the feedback current $I_{FB}$ is raised or decreased, the feedback voltage $V_{FB}$ is also gradually raised or decreased. Thus, if the feedback voltage $V_{FB}$ is equal to the ideal grayscale voltage $V_{gray}$, at this time, the comparison control unit 120 control the third switch signal SW3 as the low level voltage. At this time, the third compensation TFT T5 is cut off, thus the second electrode of the capacitor C1 is stopped to receive the high level compensation $V_{high}$ or the low level compensation voltage $V_{low}$. The second electrode of the capacitor C1 maintains current voltage. That is, the gate of the driving TFT T1 maintains current voltage. Thus, in the lighting interval, the driving current passed through the OLED is achieved the desired value, and the brightness of the OLED is also achieved the desired value.

For obtaining the ideal grayscale voltage $V_{gary}$, in this embodiment, the compensation circuit 100 further includes a signal source 140 and the signal source 140 is configured to output the ideal grayscale voltage $V_{gary}$, wherein the signal source 140 is configured to output a n-level ideal grayscale voltage $V_{gary}$, n is an integer greater than or equal to 2 such as 2, 4, 8, 16, 32, 64, 128, 256 or etc. The signal source 140 only outputs one level ideal grayscale voltage $V_{gary}$. In this embodiment, n is $2^M$, M is a positive integer. In this embodiment, n is 256. In this embodiment, the signal source 140 receives digital signal and outputs the ideal grayscale voltage $V_{gary}$ corresponding to the digital signal received. The OLED can output n-level grayscale corresponding to the n-level ideal grayscale voltage $V_{gary}$, that is, the OLED can light with n-level brightness.

Figure 4:
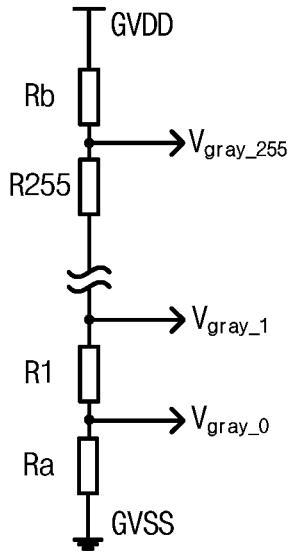
FIG. 4 is a schematic of resistors in series within the gamma circuit of a signal source according to the first embodiment of the disclosure.

In this embodiment, the signal source 140 includes gamma circuit. Reference is made to FIG. 4, the gamma circuit includes n+1 resistors, respectively as resistor Ra, resistor R1, resistor R2, resistor R3 . . . , resistor R254, resistor R255, and resistor Rb. The n+1 resistors are in series, the resistor Ra far from the end of resistor R1 receives low level voltage of power supply GVSS, and the resistor Rb far from the end of resistor R255 receives high level voltage of power supply GVDD. The resistor R255 is configured to output the value of 256-level ideal grayscale voltage $V_{gary-25}$, and the resistor Ra is configured to output the value of 1-level ideal grayscale voltage $V_{gary-0}$. Thus, the resistances of the resistors Ra, Rb are set according to the value of 256-level ideal grayscale voltage $V_{gary-2}$ and the value of 1-level ideal grayscale voltage $V_{gary-0}$.

For reducing the gamma calibration hereafter, in this embodiment, 1-level to 255-level ideal grayscale voltages $V_{gary}$, are satisfied to gamma curve formula that index is γ, that is:

$$V_{gray-x} = (V_{gray-255} - V_{gray-0}) \cdot \left(\frac{x}{255}\right)^{\gamma};$$

wherein $V_{gray-x}$ is x-level ideal grayscale voltage $1 \le x \le 255$, the γ is predetermined gamma value, the γ is 2.2 in this embodiment. However, in this disclosure, the γ is set according to the practice need. In this embodiment, the difference between two adjacent ideal grayscale voltages $V_{gary}$ is following:

$$V_{gray-255} - V_{gray-254} = (V_{gray-255} - V_{gray-0}) \cdot \left[\left(\frac{255}{255}\right)^{\gamma} - \left(\frac{254}{255}\right)^{\gamma}\right];$$

$$V_{gray-254} - V_{gray-253} = (V_{gray-255} - V_{gray-0}) \cdot \left[\left(\frac{254}{255}\right)^{\gamma} - \left(\frac{253}{255}\right)^{\gamma}\right];$$

$$\vdots$$

$$V_{gray-1} - V_{gray-0} = (V_{gray-255} - V_{gray-0}) \cdot \left[\left(\frac{1}{255}\right)^{\gamma} - \left(\frac{0}{255}\right)^{\gamma}\right].$$

Since the resistors R1, R2 . . . , R255 are in series, thus:

$$R_1 : R_2 : \ldots R_{254} : R_{255} = \left(\frac{1}{255}\right)^{\gamma} : \left[\left(\frac{2}{255}\right)^{\gamma} - \left(\frac{1}{255}\right)^{\gamma}\right] : \ldots : \left[\left(\frac{254}{255}\right)^{\gamma} - \left(\frac{253}{255}\right)^{\gamma}\right] : \left[\left(\frac{255}{255}\right)^{\gamma} - \left(\frac{254}{255}\right)^{\gamma}\right]$$

In this embodiment, since the resistors R1, R2 . . . , R255 are satisfied in above formula, thus the gamma circuit only includes (n+1) resistors in this embodiment. Compared with conventional gamma circuit, there are thousands of small resistors with the same resistance in series, as many as several thousands of small resistors with the same resistance. This embodiment not only can achieve outputting the n-level ideal grayscale voltage $V_{gray}$, but also concurrently reduce the number of the resistors within the gamma circuit of the signal source 140, so as to reduce the complexity of the gamma circuit and the signal source 140. Moreover, since R1:R2:R3: . . . :R255 is satisfied the formula above, the ideal grayscale voltage $V_{gray}$ is also satisfied the gamma adjusting that index is γ, and the brightness of the OLED is satisfied to the gamma adjusting that index is γ. Therefore, the operation of the gamma calibration hereafter is reduced.

In addition, for maintaining the voltage at the second electrode of the capacitor C1. In this embodiment, please referring to FIG. 1, the OLED driving compensation circuit further includes a maintain capacitor C2. A first electrode of the maintain capacitor C2 is coupled to the first end of the switch TFT T2, and the first electrode of the maintain capacitor C2 is also coupled to the second end of the initial TFT T6. A second electrode of the maintain capacitor C2 is coupled to the ground. In reset interval, the reference voltage $V_{ref}$ concurrently initializes the first electrode of the capacitor C1 and the first electrode of the maintain capacitor C2. After the reset interval, the first electrode of the capacitor C1 and the first electrode of the maintain capacitor C2 are the reference voltage $V_{ref}$. In compensation interval, the compensation voltage concurrently is compensated to the first electrode of the capacitor C1 and the first electrode of the maintain capacitor C2. If the feedback voltage $V_{FB}$ is equal to the ideal grayscale voltage $V_{gray}$, the compensation voltage is stopped to compensate the first electrode of the capacitor C1 and the first electrode of the maintain capacitor C2. At this time, the switch TFT T2 is still conducted. Since the maintain capacitor C2, that the voltage at the second electrode of the capacitor C1 is rapidly lowering due to leakage can be prevented.

This disclosure further provides an active organic light-emitting diode (AMOLED) display panel, and the AMOLED includes the OLED driving compensation circuit said above.

Figure 5:
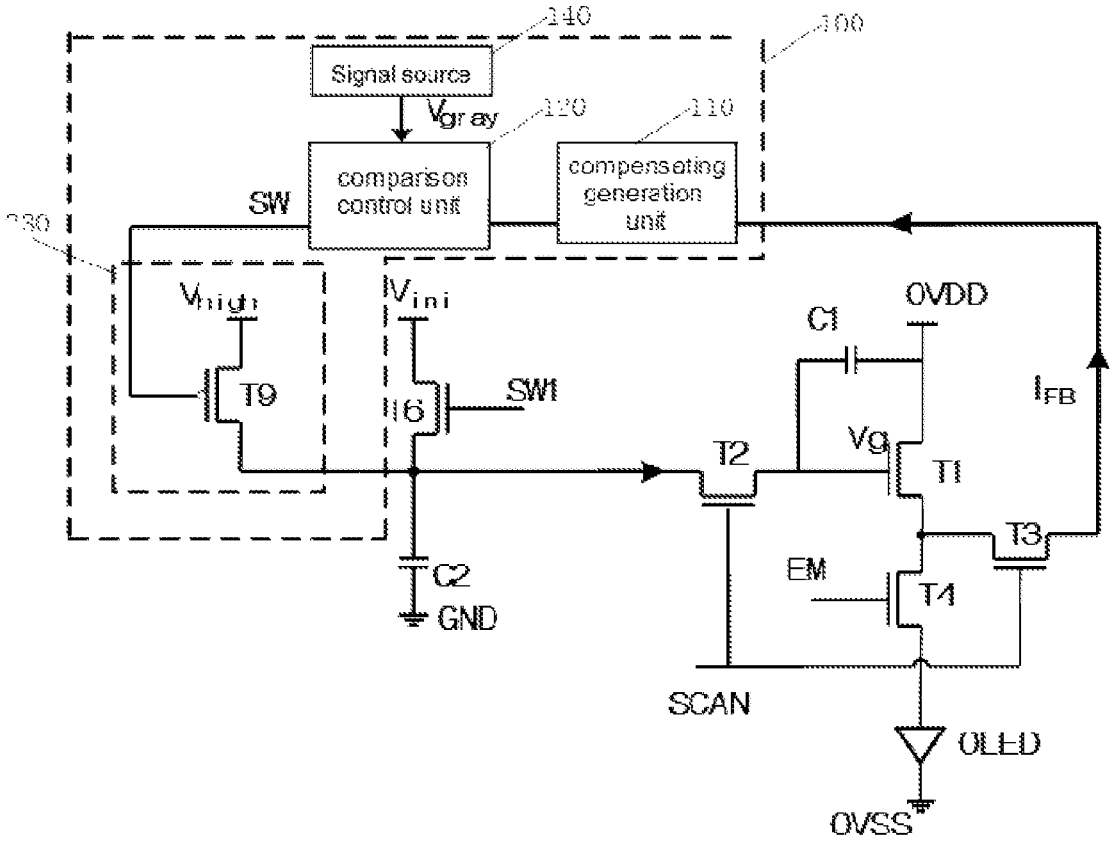
FIG. 5 is a schematic of an OLED driving compensation circuit according to second embodiment of the disclosure.

FIG. 5 is a schematic of an OLED driving compensation circuit according to second embodiment of the disclosure. FIG. 5 is similar to FIG. 1, thus the same symbols represent the same elements. The difference between this embodiment and the embodiment above is compensating generation unit.

Figure 6:
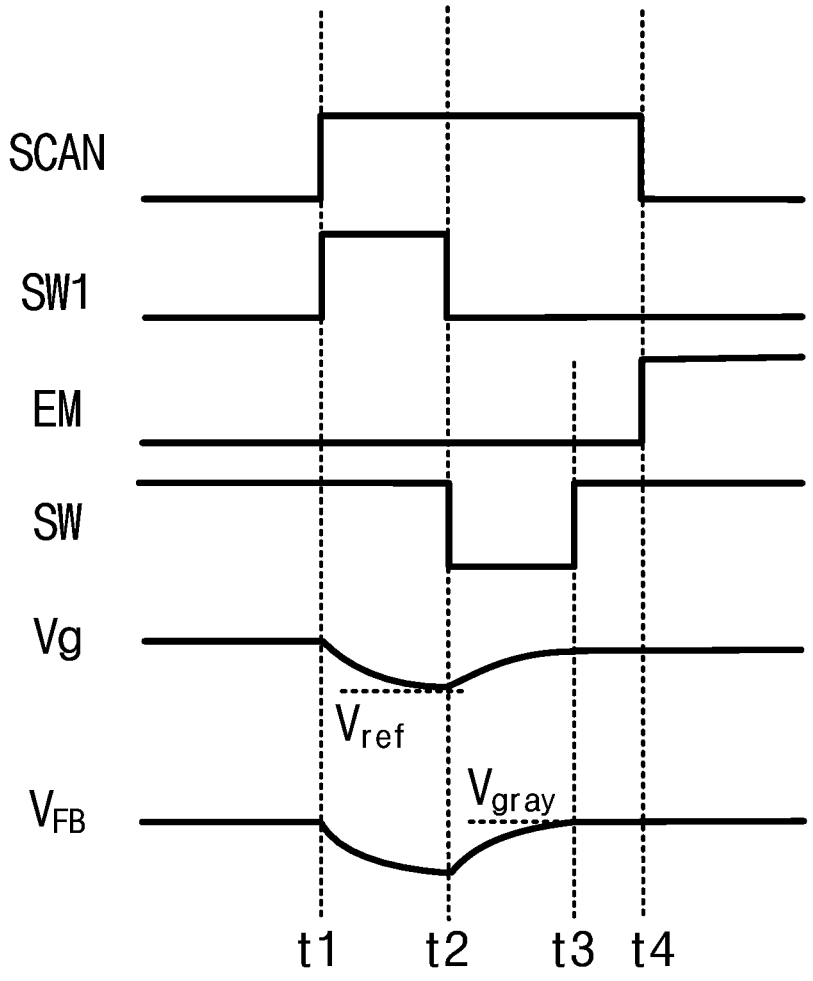
FIG. 6 is a clock schematic of the OLED driving compensation circuit according to the second embodiment of the disclosure.

Reference is made to FIGS. 5 and 6. In this embodiment, the compensating generation unit 230 doesn't generate two kinds of compensation voltages, and only one compensation voltage which is the high level compensation voltage $V_{high}$. However, in other embodiments, based on practice need, the compensation voltage also can be the low level compensation voltage $V_{low}$. In this embodiment, the compensating generation unit 230 includes a fourth compensation TFT T9. A first end of the fourth compensation TFT T9 receives a high level compensation voltage $V_{high}$, a second end of the fourth compensation TFT T9 is coupled to the first end of the switch TFT T2, and a gate of the fourth compensation TFT T9 receives the control signal SW. In this embodiment, the fourth compensation TFT T9 is P-type TFT, the first end thereof is source, and the second end thereof is drain. In addition, in other embodiments, the fourth compensation TFT T9 is N-type TFT. In addition, the first end thereof is drain, and the second end thereof is source.

In this embodiment, the first end of the initial TFT T6 receives the reference $V_{ini}$ is low level voltage. In the reset interval, the second electrode of the capacitor C1 is initialized to the low level voltage. In here, the reference voltage $V_{ini}$ is lower than the 0-level ideal grayscale voltage $V_{gray\text{-}0}$. In the compensation interval, initially the ideal grayscale voltage $V_{gray}$ shall be greater than the feedback voltage $V_{FB}$. At this time, the control signal SW is the low level voltage, the fourth compensation TFT T9 is conducted, the high level compensation voltage $V_{high}$ is outputted to the second electrode of the capacitor C1 via the switch TFT T2 to charge the capacitor C1. Thus, the gate voltage $V_g$ at the gate of the driving TFT T1 is gradually raised, so as to gradually raise the feedback current $I_{FB}$. Correspondingly, the feedback voltage $V_{FB}$ is also gradually raised. However, if the feedback voltage $V_{FB}$ is raised and equal to the ideal grayscale voltage $V_{gray}$, the control signal SW outputted from the comparison control unit 120 is changed from the low level voltage to the high level voltage. The fourth TFT T9 is conducted, and the high level compensation voltage $V_{high}$ is stopped to charge the capacitor C1. Thus, the second electrode of the capacitor C1 maintains current voltage. After, in the lighting interval, according to the gate voltage $V_g$ of the driving TFT T1, the driving current passed through the OLED is the desired current. The brightness of the OLED is reached to the desired value, and quality of the AMOLED display panel is better. Moreover, due to the compensation of the compensation circuit, when two ideal grayscale voltages $V_{gray}$ the compensation circuit 100 are identical to each other, the driving currents passed through the OLED are also the same in the lighting interval. It doesn't cause difference between brightness values of the OLED due to the threshold voltage drifting or the impedance of the panel made by own-alignment of the driving TFT T1. Therefore, the display stability in respective with the AMOLED display panel is better.

It is noted that, the various embodiments in this disclosure are described in a progressive manner. Each embodiment focuses on the differences from other embodiments, and the same or similar parts among the embodiments may refer to each other. Since the apparatus embodiment is basically similar to the method embodiment, the description is relatively simple, and for the relevant parts, reference may be made to the part of the method embodiments.

Since the OLED driving compensation circuit further includes a compensation circuit. The compensation circuit receives a feedback current passed through the second end of the driving TFT and generates a compensation voltage according to the feedback current, and the compensation circuit is compensated by the switch TFT outputs the compensation voltage to the capacitor. Thus, the compensation voltage is able to compensate the voltage for the second electrode of the capacitor, and that is to compensate the voltage for the gate of the driving TFT, so as to achieve desired value of driving current that passes through the OLED. By achieving desired brightness and grayscale, the impact of threshold voltage, panel trace impedance for the driving current can be overcome, thus the display stability in respective with the AMOLED display panel is better.

The foregoing contents are detailed description of the disclosure in conjunction with specific preferred embodiments and concrete embodiments of the disclosure are not limited to these description. For the person skilled in the art of the disclosure, without departing from the concept of the disclosure, simple deductions or substitutions can be made and should be included in the protection scope of the application.

What is claimed is:

1. An OLED (organic light emitting diode) driving compensation circuit, comprising an OLED, a capacitor, a driving TFT (thin film transistor), a switch TFT, a lighting TFT, and an initial TFT;

wherein a first electrode of the capacitor receives a voltage of power supply, a second electrode of the capacitor is coupled to a gate of the driving TFT, a first end of the initial TFT receives a reference voltage, and a second end of the initial TFT is coupled to a first end of the switch TFT, a gate of the initial TFT receives a first switch signal, a second end of the switch TFT is coupled to a gate of the driving TFT, a gate of the switch TFT receives a scanning signal, a first end of the driving TFT receives the voltage of power supply, a second end the driving TFT is coupled to a first end of the lighting TFT, a gate of the lighting TFT receives an enable signal, a second end of the lighting TFT is coupled to an anode of the OLED, and a cathode of the OLED receives a low level voltage, wherein the OLED driving compensation circuit further comprises a compensation circuit, the compensation circuit receives a feedback current passed through the second end of the driving TFT and generates a compensation voltage according to the feedback current, and the compensation circuit is compensated by the switch TFT outputs the compensation voltage to the capacitor, wherein a period of the OLED driving compensation circuit comprises a reset interval, a compensation interval and a lighting interval, in the reset interval, the initial TFT and the switch TFT are conducted, and the reference voltage is outputted to the second electrode of the capacitor via the initial TFT and the switch TFT;

in the compensation interval, the initial TFT is cut off and the switch TFT is still conducted, the compensation circuit receives the feedback current to generate the compensation voltage, and the compensation voltage is outputted to the second electrode of the capacitor via the switch TFT; and in the lighting interval, the switch TFT is cut off and the lighting TFT is conducted to light the OLED.

2. The OLED driving compensation circuit according to claim 1, wherein the compensation circuit comprises a voltage converting unit, a comparison control unit, and a compensating generation unit, the voltage converting unit receives the feedback current and accordingly converts the feedback current into a feedback voltage, the comparison control unit outputs a control signal according to a comparison result of the feedback voltage and an ideal grayscale voltage respectively received by the comparison control unit, the compensating generation unit outputs the compensation voltage generated from the control signal received by the compensating generation unit to the second electrode of the capacitor via the switch TFT.

3. The OLED driving compensation circuit according to claim 2, wherein the compensating generation unit comprises a first compensation TFT, a second compensation TFT and a third compensation TFT, the control signal comprises a second switch signal and a third switch signal, a gate of the first compensation TFT receives the second switch signal, a first end of the first compensation TFT receives a high level compensation voltage and a second end of the first compensation TFT is coupled to a first end of the third compensation TFT, a first end of the second compensation TFT is coupled to the first end of the third compensation TFT, a gate of the second compensation TFT receives the second switch signal, a second end of the second compensation TFT receives a low compensation voltage, a second end of the third compensation TFT is coupled to the first end of the switch compensation TFT, a gate of the third compensation TFT receives the third switch signal, wherein at the same time, one of the first compensation TFT and the third compensation TFT is conducted, the third switch signal controls outputting the compensation voltage to the capacitor by conducting or cutting off the third compensation TFT.

4. The OLED driving compensation circuit according to claim 2, wherein the reference voltage is the low level voltage, the compensating generation unit comprises a fourth compensation TFT, the a first end of the fourth compensation TFT receives a high level compensation voltage, a second end of the fourth compensation TFT is coupled to the first end of the switch TFT, and a gate of the fourth compensation TFT receives the control signal.

5. The OLED driving compensation circuit according to claim 2, wherein the compensation circuit further comprises a signal source; and the signal source is configured to output the ideal grayscale voltage.

6. The OLED driving compensation circuit according to claim 3, wherein the compensation circuit further comprises a signal source; and the signal source is configured to output the ideal grayscale voltage.

7. The OLED driving compensation circuit according to claim 5, wherein the signal source is configured to output a n-level ideal grayscale voltage, n is an integer greater than or equal to 2, the signal source comprises n−1 resistors, the n−1 resistors are configured to output a (n−1)-level ideal grayscale voltage, the resistance ratio of the n−1 resistors is:

$$\left(\frac{1}{n-1}\right)^{\gamma}:\left[\left(\frac{2}{n-1}\right)^{\gamma}-\left(\frac{1}{n-1}\right)^{\gamma}\right]:\ldots:\left[\left(\frac{n-2}{n-1}\right)^{\gamma}-\left(\frac{n-3}{n-1}\right)^{\gamma}\right]:\left[\left(\frac{n-1}{n-1}\right)^{\gamma}-\left(\frac{n-2}{n-1}\right)^{\gamma}\right]$$

wherein, $\gamma$ is a predetermined gamma value.

8. The OLED driving compensation circuit according to claim 7, wherein n is $2^M$, M is a positive integer.

9. An OLED (organic light emitting diode) driving compensation circuit, comprising an OLED, a capacitor, a driving TFT (thin film transistor), a switch TFT, a lighting TFT, and an initial TFT;

wherein a first electrode of the capacitor receives a voltage of power supply, a second electrode of the capacitor is coupled to a gate of the driving TFT, a first end of the initial TFT receives a reference voltage, and a second end of the initial TFT is coupled to a first end of the switch TFT, a gate of the initial TFT receives a first switch signal, a second end of the switch TFT is coupled to a gate of the driving TFT, a gate of the switch TFT receives a scanning signal, a first end of the driving TFT receives the voltage of power supply, a second end the driving TFT is coupled to a first end of the lighting TFT, a gate of the lighting TFT receives an enable signal, a second end of the lighting TFT is coupled to an anode of the OLED, and a cathode of the OLED receives a low level voltage, wherein the OLED driving compensation circuit further comprises a compensation circuit, the compensation circuit receives a feedback current passed through the second end of the driving TFT and generates a compensation voltage according to the feedback current, and the compensation circuit is compensated by the switch TFT outputs the compensation voltage to the capacitor, wherein the OLED driving compensation circuit further comprises a maintain capacitor configured for maintaining the voltage in respect with the second electrode of the capacitor, a first electrode of the maintain capacitor is coupled to the first end of the switch TFT, and a second electrode of the maintain capacitor is coupled to the ground.

10. An active organic light-emitting diode (AMOLED) display panel, comprising an OLED driving compensation circuit, wherein the OLED driving compensation circuit comprises an OLED, a capacitor, a driving TFT (thin film transistor), a switch TFT, a lighting TFT, and an initial TFT;

wherein a first electrode of the capacitor receives a voltage of power supply, a second electrode of the capacitor is coupled to a gate of the driving TFT, a first end of the initial TFT receives a reference voltage, and a second end of the initial TFT is coupled to a first end of the switch TFT, a gate of the initial TFT receives a first switch signal, a second end of the switch TFT is coupled to a gate of the driving TFT, a gate of the switch TFT receives a scanning signal, a first end of the driving TFT receives the voltage of power supply, a second end the driving TFT is coupled to a first end of the lighting TFT, a gate of the lighting TFT receives an enable signal, a second end of the lighting TFT is coupled to an anode of the OLED, and a cathode of the OLED receives a low level voltage, wherein the OLED driving compensation circuit further comprises a compensation circuit, the compensation circuit receives a feedback current passed through the second end of the driving TFT and generates a compensation voltage according to the feedback current, and the compensation circuit is compensated by the switch TFT outputs the compensation voltage to the capacitor, wherein a period of the OLED driving compensation circuit comprises a reset interval, a compensation interval and a lighting interval, in the reset interval, the initial TFT and the switch TFT are conducted, and the reference voltage is outputted to the second electrode of the capacitor via the initial TFT and the switch TFT;

in the compensation interval, the initial TFT is cut off and the switch TFT is still conducted, the compensation circuit receives the feedback current to generate the compensation voltage, and the compensation voltage is outputted to the second electrode of the capacitor via the switch TFT; and in the lighting interval, the switch TFT is cut off and the lighting TFT is conducted to light the OLED.

11. The AMOLED display panel according to claim 10, wherein the compensation circuit comprises a voltage converting unit, a comparison control unit, and a compensating generation unit, the voltage converting unit receives the feedback current and accordingly converts the feedback current into a feedback voltage, the comparison control unit outputs a control signal according to a comparison result of the feedback voltage and an ideal grayscale voltage respectively received by the comparison control unit, the compensating generation unit outputs the compensation voltage generated from the control signal received by the compensating generation unit to the second electrode of the capacitor via the switch TFT.

12. The AMOLED display panel according to claim 11, wherein the compensating generation unit comprises a first compensation TFT, a second compensation TFT and a third compensation TFT, the control signal comprises a second switch signal and a third switch signal, a gate of the first compensation TFT receives the second switch signal, a first end of the first compensation TFT receives a high level compensation voltage and a second end of the first compensation TFT is coupled to a first end of the third compensation TFT, a first end of the second compensation TFT is coupled to the first end of the third compensation TFT, a gate of the second compensation TFT receives the second switch signal, a second end of the second compensation TFT receives a low compensation voltage, a second end of the third compensation TFT is coupled to the first end of the switch compensation TFT, a gate of the third compensation TFT receives the third switch signal, wherein at the same time, one of the first compensation TFT and the third compensation TFT is conducted, the third switch signal controls outputting the compensation voltage to the capacitor by conducting or cutting off the third compensation TFT.

13. The AMOLED display panel according to claim 11, wherein the reference voltage is the low level voltage, the compensating generation unit comprises a fourth compensation TFT, the a first end of the fourth compensation TFT receives a high level compensation voltage, a second end of the fourth compensation TFT is coupled to the first end of the switch TFT, and a gate of the fourth compensation TFT receives the control signal.

14. The AMOLED display panel according to claim 11, wherein the compensation circuit further comprises a signal source; and the signal source is configured to output the ideal grayscale voltage.

15. The AMOLED display panel according to claim 12, wherein the compensation circuit further comprises a signal source; and the signal source is configured to output the ideal grayscale voltage.

16. The AMOLED display panel according to claim 14, wherein the signal source is configured to output a n-level ideal grayscale voltage, n is an integer greater than or equal to 2, the signal source comprises n−1 resistors, the n−1 resistors are configured to output a (n−1)-level ideal gray-scale voltage, the resistance ratio of the n−1 resistors is:

$$\left(\frac{1}{n-1}\right)^{\gamma}:\left[\left(\frac{2}{n-1}\right)^{\gamma}-\left(\frac{1}{n-1}\right)^{\gamma}\right]:\ldots:\left[\left(\frac{n-2}{n-1}\right)^{\gamma}-\left(\frac{n-3}{n-1}\right)^{\gamma}\right]:\left[\left(\frac{n-1}{n-1}\right)^{\gamma}-\left(\frac{n-2}{n-1}\right)^{\gamma}\right]$$

wherein, γ is a predetermined gamma value.

17. The AMOLED display panel according to claim 16, wherein n is $2^{M}$, M is a positive integer.

18. The AMOLED display panel according to claim 10, further comprising a maintain capacitor configured for maintaining the voltage in respect with the second electrode of the capacitor, a first electrode of the maintain capacitor is coupled to the first end of the switch TFT, and a second electrode of the maintain capacitor is coupled to the ground.

* * * * *